United States Patent [19]

Dewing et al.

[11] 4,261,736

[45] Apr. 14, 1981

[54] CARBOTHERMIC PRODUCTION OF ALUMINIUM

[75] Inventors: Ernest W. Dewing; Raman R. Sood; Frederick W. Southam, all of Kingston, Canada

[73] Assignee: Alcan Research and Development Limited, Montreal, Canada

[21] Appl. No.: 138,327

[22] Filed: Apr. 8, 1980

[30] Foreign Application Priority Data

Apr. 10, 1979 [GB] United Kingdom ..... 12496/79

[51] Int. Cl.[3] ..... C22B 21/02

[52] U.S. Cl. ..... 75/68 A; 75/10 R; 75/25

[58] Field of Search ..... 75/10 R, 68 A, 25

[56] References Cited

U.S. PATENT DOCUMENTS 4,099,959 7/1978 Dewing et al. ..... 75/25

4,177,060 12/1979 Tylko ..... 75/68 A

*Primary Examiner*—M. J. Andrews

*Attorney, Agent, or Firm*—Cooper, Dunham, Clark, Griffin & Moran

[57] ABSTRACT

In a process for the treatment of fume-laden carbon monoxide evolved in carbothermic reduction of alumina the fume-laden gas is contacted with particulate carbon in a fluidized bed maintained at a temperature, preferably in the range 2010°-2050° C. and above that at which sticky aluminium oxycarbide forms. The temperature of the bed is most conveniently controlled by the rate at which fresh carbon feed material is added to the bed. The hot gas emerging from the bed is rapidly chilled to a temperature below the solidification point of aluminium oxycarbide. This is most conveniently achieved by contact with a large excess of cool alumina/carbon mix in a stream which is continuously circulated through a heat exchange stage.

7 Claims, 1 Drawing Figure

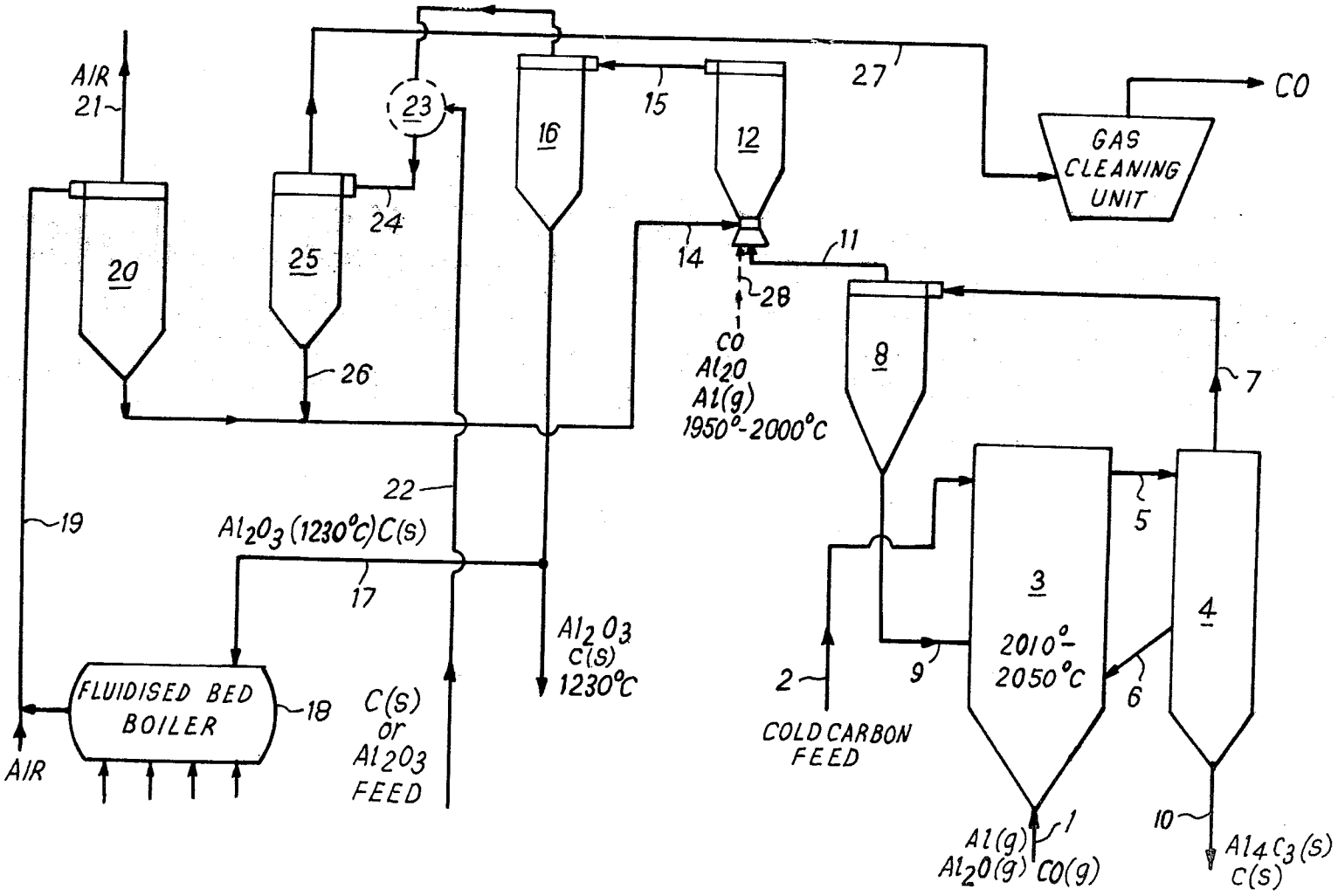
CO
GAS CLEANING UNIT
27
7
4
5
6
10
$Al_4C_3(s)$
$C(s)$
3
2010°-2050°C
1
$Al(g)$
$Al_2O(g)$
$CO(g)$
9
8
11
2
COLD CARBON FEED
12
28
CO
$Al_2O$
$Al(g)$
1950°-2000°C
14
15
16
$Al_2O_3$
$C(s)$
1230°C
23
24
22
17
$C(s)$ or $Al_2O_3$ FEED
25
26
$Al_2O_3$ (1230°C) $C(s)$
18
FLUIDISED BED BOILER
20
AIR
21
19
AIR

CARBOTHERMIC PRODUCTION OF ALUMINIUM

The present invention relates to the production of aluminum metal by carbothermic reduction of alumina.

The reduction of alumina with carbon is highly endothermic and only proceeds to the production of aluminium metal (in the absence of other reducible oxides) at temperatures in excess of 2050° C. The production of aluminium metal at these very high temperatures is accompanied by evolution of very large volumes of carbon monoxide.

Many different proposals for carbothermic reduction of essentially pure alumina have been put forward and some practical success has been obtained.

Thus in U.S. Pat. No. 2,974,032 a reaction mixture of carbon and alumina was heated from above with an open arc from carbon electrodes at a temperature in excess of 2400° C.

In U.S. Pat. No. 3,783,167 it has been proposed to produce aluminium by carbothermic reduction of alumina in the plasma of a plasma furnace.

In U.S. Pat. No. 4,099,959 it has been proposed to produce aluminium by carbothermic reduction of alumina by reacting alumina and carbon in a first zone to form aluminium carbide, $Al_4C_3$, and then to forward an alumina slag, containing dissolved $Al_4C_3$, to a second zone maintained at higher temperature, about 2050°-2100° C., at which $Al_4C_3$ reacts with additional alumina to release Al metal, carbon monoxide being released in both the cooler first zone and the hotter second zone.

In all the above-mentioned processes and, indeed, in any process involving carbothermic reduction of alumina, the actual production of aluminium metal involves an operating temperature in the reaction zone (or final reaction zone) of at least 2050° C. and usually higher. At such temperatures the partial pressures of Al vapour and $Al_2O$, aluminium suboxide, are substantial and these components back-react exothermically with the evolved carbon monoxide as the gas temperature is lowered. Such back-reaction is highly exothermic and represents a very large potential loss of energy. Furthermore it gives rise to the formation of deposits of aluminium oxycarbide, which are sticky and tend to block up gas conduits.

It has already been proposed in U.S. Pat. No. 4,099,959 to counteract these difficulties by leading the CO from the higher temperature zone into contact with the incoming feed carbon, so that there is reaction of the Al vapour and $Al_2O$ content of the carbon monoxide with the carbon to form a non-sticky $Al_4C_3$ with simultaneous generation of heat energy for preheating the carbon feed. Thus at least a part of the heat energy represented by the Al vapour and $Al_2O$ content of the carbon monoxide was recovered by the formation of $Al_4C_3$ and by preheating of the carbon feed. In that envisaged system the fume-laden carbon monoxide was passed through a bed of relatively large pieces which were essentially stationary in relation to each other. However in such a system there is a grave risk of accidental formation of aluminium oxycarbide with consequent cementing of the lumps of carbon to one another.

It is a principal object of the present invention to provide an improved method for treating such fume-laden carbon monoxide to recover energy in chemical form, by producing $Al_4C_3$, and as usable heat, which may be used to generate electricity or be harnessed in some other way.

The essential feature of the present invention resides in contacting the fume-laden gas with particulate carbon in a fluidised bed maintained at a temperature above the temperature at which sticky aluminium oxycarbide forms (approximately 2010° C.).

In order to maintain control of the temperature in the fluidised bed additional carbon, either hot or cold, is introduced in carefully controlled amounts into the fluidised bed. The reactions $$4Al+3C=Al_4C_3$$

and $$2Al_2O+5C=Al_4C_3+2CO$$

are exothermic, so that normally additional heat is not needed.

The heat of reaction is employed (in addition to making good the inevitable heat losses of the reactor containing the fluidised bed of carbon) to heat up the cold carbon feed to reaction temperature. The temperature in the fluidised bed reactor can be controlled by increase or decrease of the carbon feed to the fluidised bed reactor. Increase in the carbon feed will result in more heat being taken up by cold carbon feed and in most instances it will be found that a slight excess of carbon feed will be required to maintain the system in balance, so that the take-off of material from the fluidised bed reactor will be essentially $Al_4C_3$ with a relatively small proportion of unreacted carbon. Carbon feed rate to the reactor can be controlled automatically to respond to change in the reactor temperature.

In order to avoid collapse of the fluidised bed through deposition of sticky aluminium oxycarbide with consequent agglomeration of the solid particles in the fluidised bed, it is important to maintain the normal operating temperature of the fluidised bed reactor at a temperature such that the reaction product is solid $Al_4C_3$. However small scale deposition of oxycarbide, resulting from short duration temperature fall, will normally be broken up by the movement of the fluidised carbon particles.

The gas, with depleted Al vapour and $Al_2O$ content, is passed from the fluidised bed reactor to a second energy recovery stage, in which the sensible heat of the gas and the heat energy, generated by back-reaction of the remaining Al vapour and $Al_2O$ with CO, is recovered as far as possible. In this stage energy recovery is preferably effected by contacting the gas with a large mass of solids under conditions such that the gas is very rapidly and indeed almost instantaneously chilled to a temperature below the solidification temperature of aluminium oxycarbide. The cold or relatively cool mass of solids employed to take up heat from the gas stream is most preferably alumina or carbon feed material for the carbothermic process. However the heat taken up by the solids is far in excess of the amount required to heat the feed material before charging to the carbothermic reduction furnace. The larger part of the thus heated solids are therefore forwarded to a heat exchange boiler, where the temperature of the solids is reduced to, say, 200° C. and the thermal content of the solids is employed in steam raising. A minor part of the heated solids is forwarded to the reduction furnace as feed and a make-up quantity is added to the solids recirculated from the boiler to the gas/solids heat exchange apparatus. The CO gas from the heat exchange apparatus may conveniently be fed directly to and burnt in a steam-raising boiler or used for chemical synthesis.

An example of a complete system for the treatment of the off-gas from a carbothermic reduction furnace of the type described in U.S. Pat. No. 4,099,959 is illustrated in the accompanying diagrammatic drawing.

In the drawing the fume-laden gas from a carbothermic reduction furnace enters a fluidised bed reactor 3 via a conduit 1. A fluidised bed of granular carbon is maintained in the reactor and fresh cold carbon feed material may be supplied continuously or intermittently to the top of the fluidised bed in reactor 3 via a supply conduit 2.

Gas from the fluidised bed is led out into a primary separator 4 via a conduit 5. The bulk of the solid material separated in separator 4 is returned via conduit 6 to the fluidised bed in reactor 3. The gas from separator 4 is led via conduit 7 to a high temperature cyclone separator system 8, in which solid fines are collected and returned via a conduit 9 to reactor 3.

Material, consisting essentially of carbon and aluminium carbide, is drawn off continuously or intermittently from separator 4 and is fed to the carbothermic furnace via a conduit 10.

In operating the reactor 3 the target is to maintain the temperature of the fluidised bed as close as possible to 2010° C. (but without falling below that temperature). The temperature of the fluidised bed should not rise above 2050° C. since the quantity of aluminium values recovered in the bed as $Al_4C_3$ might then be too small.

As already stated the reactions of carbon with $Al_2O$ and Al vapour in reactor 3 are exothermic and the produced heat should be in excess of the heat losses of the fluidised bed reactor system. Control of the temperature in the fluidised bed is effected by increase or decrease of the carbon feed which is supplied in an amount in excess of that required to replace carbon consumed in the reactor 3 in transforming a proportion of the $Al_2O$ and Al fume content of the gas to aluminium carbide $Al_4C_3$.

If the carbothermic reduction furnace is of the type described in U.S. Pat. No. 4,099,959 with a low-temperature zone or zones, the gas from these zones may be introduced into the recuperation system after the first scrubber. Where the low-temperature zone(s) off-gas is treated in the system this can conveniently be achieved by introducing it at a temperature of about 1950°C.–2000° C. via conduit 28 to reactor 12.

The function of reactor 3 is to recover $Al_2O$ and Al vapour from gas issuing from the carbothermic reactor in the form of $Al_4C_3$ which is then returned (together with excess carbon) in highly heated condition to the carbothermic reduction furnace.

Further recovery of heat from the gases from the furnace is achieved in the secondary heat recovery system now to be described. The energy to be recovered in the secondary heat recovery system is partly the sensible heat of the gas and partly the potential chemical energy of the $Al_2O$ and Al vapour remaining in the gas issuing from the high temperature cyclone 8, and, if conduit 28 is used, the gas is introduced through it. The gas from cyclone 8 is still preferably at a temperature above 2010° C to prevent growth of sticky oxycarbide deposits in the cyclone separator and is led via conduit 11 to a reactor 12 in which the gas is mixed with a large mass of carbon/alumina mix which enters the reactor 12 at a relatively low temperature via conduit 14.

The gas is rapidly chilled in the reactor 12 by heat exchange with the incoming mass of solid particles, despite the exothermic reaction resulting from the presence of the remaining $Al_2O$ and Al vapour in the incoming gas stream. The mass of solid coolant is such that the formation of a minor quantity of aluminium oxycarbide therein is too small to have an adverse clogging effect. The mass of solid coolant is preferably 3–4 times the mass of the gas (including its fume content). This is effective to chill the gas stream by, for example, one thousand degrees centigrade. The mixture of gas and solids from reactor 12 are carried over via conduit 15 to a separator 16, from which the separated solids, typically at a temperature of 1200°–1300° C., are forwarded to a fluidised bed boiler 18 via conduit 17. The steam raised in boiler 18 may be employed in any desired way.

A minor proportion of the solids is bled off from conduit 17 for supply to the carbothermic reduction furnace. This minor proportion may be used to supply the whole of the remainder of the requirements of the alumina or of the carbon requirement of the furnace, allowing for aluminium carbide and carbon already supplied via conduit 10. However for control reasons the balance of either the alumina or carbon supply to the carbothermic furnace is from a separate source. The composition of the carbon/alumina mix in the solids supplied to reactor 12 is dependent upon whether the solids stream is employed to supply the balance of the alumina and/or carbon requirements of the carbothermic reduction furnace.

The cooled solids issuing from the boiler 18 are transported by air lift up a conduit 19 to a cyclone 20, at which the air is discharged via an outlet 21. From cyclone 20 the cooled solids are recirculated to reactor 12 through the conduit 14.

Make-up solids (either carbon or alumina) are supplied to the circulating solids stream through an inlet conduit 22, leading to a mixer 23, where the make-up solids are heated by heat exchange with the gas stream issuing from separator 16, from whence it is led via conduit 24 to a separator 25 and through conduit 26 into conduit 14. The gas stream, consisting essentially of carbon monoxide, from separator 25, is discharged through conduit 27 to conventional gas cleaning equipment.

We claim:

1. In a process for the carbothermic reduction of alumina with accompanying evolution of carbon monoxide at a temperature in excess of 2010° C. and laden with Al vapour and $Al_2O$ fume the improvement which comprises contacting said gas with particulate carbon in a fluidised bed maintained at a temperature above the temperature at which sticky aluminium oxycarbide forms.

2. A process according to claim 1 in which the fluidised bed is maintained at a temperature in the range of 2010°–2050° C.

3. A process according to claim 1 in which the temperature of the fluidised bed is controlled by supplying carbon feed material in controlled quantity to said fluidised bed.

4. A process according to claim 3 further comprising removing a quantity of heated carbon, enriched with $Al_4C_3$, from said fluidised bed.

5. In a process according to claim 1 the further improvement which comprises contacting the carbon monoxide, after issuing from said fluidised bed, with a stream of relatively cool alumina/carbon particle mix, in such quantity as to chill the gas almost instantaneously to a temperature below the solidification point of aluminium oxycarbide.

6. A process according to claim 5 further comprising separating the chilled carbon monoxide from the solid particles, heated by contact therewith, transmitting the heated solid particles to a heat recovery heat exchange stage, cooling said particles in said heat exchange stage and recirculating the thus cooled solid particles for contact with the carbon monoxide gas stream.

7. A process according to claim 6 further comprising withdrawing a proportion of heated particles from said solid particle stream before entry into said heat recovery heat exchange stage for supply as feed for the carbothermic reduction process and introducing fresh carbon or alumina into said stream as make-up for the withdrawn material.

* * * * *

UNITED STATES PATENT AND TRADEMARK OFFICE

CERTIFICATE OF CORRECTION

PATENT NO. : 4,261,736

DATED : April 14, 1981

INVENTOR(S) : Ernest W. Dewing et al.

It is certified that error appears in the above-identified patent and that said Letters Patent are hereby corrected as shown below:

Col. 3, line 62, "the gas is introduced" should read --in the gas introduced-- .

Signed and Sealed this

Sixteenth Day of November 1982

[SEAL]

*Attest:*

GERALD J MOSSINGHOFF

*Attesting Officer*

*Commissioner of Patents and Trademarks*